US011629391B2

(12) United States Patent
Guenley et al.

(10) Patent No.: US 11,629,391 B2
(45) Date of Patent: Apr. 18, 2023

(54) TARNISH AND SWEAT RESISTANT LOW KARAT GOLD ALLOYS

(71) Applicant: LeachGarner, Inc., Attleboro, MA (US)

(72) Inventors: William Guenley, Attleboro, MA (US); Mossig H. Makhoulian, Attleboro, MA (US); Joe Esposito, Attleboro, MA (US); Luke Autry, Attleboro, MA (US); Scott Suvall, Hartford, CT (US)

(73) Assignee: LEACHGARNER, INC., Attleboro, MA (US)

( * ) Notice: Subject to any disclaimer, the term of this patent is extended or adjusted under 35 U.S.C. 154(b) by 0 days.

(21) Appl. No.: 17/808,702

(22) Filed: Jun. 24, 2022

(65) Prior Publication Data

US 2022/0325381 A1 Oct. 13, 2022

Related U.S. Application Data

(63) Continuation of application No. 16/735,965, filed on Jan. 7, 2020, now Pat. No. 11,401,581.

(60) Provisional application No. 62/925,374, filed on Oct. 24, 2019, provisional application No. 62/790,657, filed on Jan. 10, 2019.

(51) Int. Cl.

| | |
|---|---|
| ***C22C 9/00*** | (2006.01) |
| ***C22F 1/08*** | (2006.01) |
| ***C22C 5/02*** | (2006.01) |

(52) U.S. Cl.
CPC ..... *C22C 9/00* (2013.01); *C22C 5/02* (2013.01); *C22F 1/08* (2013.01)

(58) Field of Classification Search
CPC ..... C22C 9/00; C22C 5/02; C22F 1/08
See application file for complete search history.

(56) References Cited

U.S. PATENT DOCUMENTS 2,216,495 A * 10/1940 Loebich ..... C22C 30/02 420/587
2,654,146 A 10/1953 Mooradian
4,446,102 A 5/1984 Bales

FOREIGN PATENT DOCUMENTS

GB 2279662 A * 1/1995 ..... A44C 27/003
GB 22799662 A 1/1995

* cited by examiner

*Primary Examiner* — John A Hevey
(74) *Attorney, Agent, or Firm* — Gottlieb, Rackman & Reisman, P.C.

(57) ABSTRACT

This invention provides low karat, low silver, 6 kt gold-copper-zinc alloys with acceptable workability that can be processed into wire, tube, sheet stock, or cast. The alloys are annealed at 1200° F., rapidly cooled, and heat treated at about 600° to 800° F., which increases the hardness and durability in finished parts made from these alloys. The alloys include grain refiners. The alloys are resistant to oxidation from sweat and tarnishing. Additional fabrication operations can form jewelry items such as balls, chain, hoops and studs.

10 Claims, 4 Drawing Sheets

Work-Hardening and annealing curves for selected 6 kt and 10 kt alloys. (A) Work-Hardening curves. (B) Annealing curves.

Figure 1: Work-Hardening and annealing curves for selected 6 kt and 10 kt alloys. (A) Work-Hardening curves. (B) Annealing curves.

Figure 2: Backscatter Electron Image (a) and EDS Spectra (b) of RD 0106 after tarnish testing.

Figure 3: Backscatter Electron Image (a) and EDS Spectra (b) of RD 0106 before tarnish testing.

TARNISH AND SWEAT RESISTANT LOW KARAT GOLD ALLOYS

CROSS REFERENCE TO RELATED APPLICATIONS

This patent claims the benefit of U.S. Patent Application 62/790,657 filed Jan. 10, 2019, and U.S. Patent Application 62/925,374, filed Oct. 24, 2019.

FIELD OF INVENTION

This application pertains to gold alloys containing 10 karats or less of gold content, in particular 6 karat gold alloys, that have acceptable workability for jewelry and are sweat and tarnish resistant.

BACKGROUND OF THE INVENTION

Gold alloys, particularly 14 karat gold and 10 karat gold are widely used in the manufacture of rings and other articles of jewelry. The properties and characteristics of such gold alloys, such as, for example, color, tarnish resistance, corrosion resistance, workability, and castability are highly desired for jewelry purposes.

The cost of the gold for such alloys accounts for a substantial portion of the overall manufacturing costs. Therefore, a gold alloy having a reduced gold content, which has the properties, characteristics, and appearance of gold alloys of higher gold content is desirable.

Conventionally, low karat (kt) yellow gold alloys are made with copper and silver, and typically have silver content above 9% in order to maintain hardenability based on the silver-copper (AgCu) precipitation reaction, used as a baseline used to compare hardenability. Age or precipitation hardening is a process whereby a non-soluble second phase is forced to precipitate from a metastable initial phase by the application of temperature and time. Metallurgically, an advantage of having no silver in the alloys is that the alloy will be single phase, which should provide superior workability. If zinc is added to a copper-gold alloy instead of silver, the zinc will completely dissolve in the copper-based phase, and diluting the copper, effectively lowering the ratio of copper to gold, which should improve the tarnish resistance.

Previous work on low karat yellow gold alloys have included alloys with silver content over 9% and zinc content under 10% (all percentages herein are w/w). For example, US Patent Publication 2010/0209287 published Aug. 19, 2010 describes a series of cast, tarnish resistant sub-10 kt gold alloys with 15-51% silver, 2-9% palladium, and 0.5-10% zinc. U.S. Pat. No. 9,428,821 describes a series of cast 6 k gold alloys with 19-23% Ag and 6-10% Zn. U.S. Pat. No. 4,264,359 describes a series of alloys with 9.75-12.10% Ag, 8.90-10.25% Zn, and 11.75-12.60% Pd. In all cases, it was claimed that the tarnish resistance of the sub-10 kt alloys were comparable to the 10 kt alloys. These alloys, however, have questionable workability as wrought forms (wire or sheet) were not produced.

Very little work has been performed on low karat gold alloys without silver. U.S. Pat. No. 4,464,213 describes a series of beta-brasses (38+% Zn) modified by gold. The 4 kt and 6 kt gold-modified beta-brass alloys were had comparable tarnish resistance to "conventional" 14 kt yellow gold alloys. Brook and Illes investigated gold modified beta-brasses and duplex alpha/beta-brasses (G. B. Brook and R. F. Iles "Gold-Copper-Zinc Alloys with Shape Memory," Gold Bulletin. March 1975, Volume 8, Issue 1, pp 16-21, https://doi.org/10.1007/BF03215059). Tarnish resistance was not evaluated by Brook and Illes as this work was not geared towards the jewelry industry, but it was reported that the alpha/beta brasses had acceptable workability and yellow color.

Based on the cited work above there is room for novel alloy development for low karat, yellow gold alloys where the silver content is limited to 9% max, and where the alloys have sufficient tarnish and sweat resistance for use in jewelry.

SUMMARY OF THE INVENTION

The present invention describes a class of low karat, low silver gold alloys with acceptable enough workability to be processed into wire, tube, and sheet stock that have improvements over prior art low karat gold alloys, in particular in being resistant to oxidation from sweat and tarnishing. Additional forming operations can form jewelry items such as balls, chain, hoops and studs. The inventive alloys can be fabricated into various colors, including yellow gold, white gold, and other colors.

The inventors have discovered that acceptable hardenability can be achieved in gold-copper alloys with low or no silver in the alloy if certain other hardening agents are added. The invention herein describes a series of cast or wrought 6 kt, low silver (<9%) gold alloys with a tarnish and sweat resistance comparable to or better than conventional 10 kt gold alloys (all percentages are w/w). These series of alloys have Ag content ranging from 0 to 8%, Zn content ranging from 8 to 24%, Pd content ranging from 0-6%, and Pt content ranging from 0-6%. In addition, these alloys may contain one or more of the following hardening agents: Al 0-3%; Co 0-4%, B 0-1%, Si 0-1%; Ru 0-1%; and Ir 0-1%, or a combination thereof. In an embodiment, B and Ir are present in an amount of 0.025% to 0.10% each.

Another embodiment of this invention provides a 6 karat gold alloy with Au 25%, Cu 45-60%, Zn 15-21%; plus one of Al 2%, Pd 4-6%, or Pt 4-6%; plus an additive selected from one of Co 0-4%, B 0-1%, and Si 0-1%; or Ru 0-1% and Ir: 0-1%, or a mixture thereof.

Another embodiment of this invention provides a 6 karat gold alloy with Au 25%; Cu 45-60%; Zn 8-24%; Ag 0-8%; Pd or Pt 0-6%; plus an additive selected from one of Co 2-4%, B 0.5-1.0%, and Ru 0.5-1.0% or a mixture thereof.

Another embodiment of this invention provides a 6 karat gold alloy with Au 25%; Cu 45-60%; Zn 8-21%; plus an additive selected from one of Pd 4-7%; Pt 4-7%; Co 2-4%; B 0.5-1.0%; or Ru 0.5-1.0% or a mixture thereof.

One embodiment of this invention has a composition of 25% Au, 7.9% Ag, 55.7% Cu, 8.9% Zn, 2.0% Co, and 0.5% B. This alloy has been processed into wire and strip, is comparably tarnish/sweat resistant to conventional 10 kt gold alloys (i.e., 42% Au), and shows good heat treatability. The color and workability is comparable to 10 kt gold alloys.

A second embodiment of this invention has a composition of: 25% Au, 50.8% Cu, 15.2% Zn, 6.0% Pd, 2.5% Co, and 0.5% B. This alloy has been processed into wire and strip, has comparable tarnish resistant to 10 kt, has superior sweat resistant to 10 kt, and shows heat treatability. The color is comparable to 10 kt. Workability is comparable to 10 kt.

A third embodiment of this invention has a composition of: 25.0% Au, 50.8% Cu, 17.7% Zn, 0.5% Ru, and 6.0% Pd. This alloy has been processed into wire and strip, has comparable tarnish resistant to 10 kt gold, has superior sweat resistant to 10 kt gold, and shows heat treatability. The color is comparable to 10 kt gold, and workability is comparable to 10 kt.

BRIEF DESCRIPTION OF THE DRAWINGS

FIG. 1. Work-Hardening and annealing curves for selected 6 kt and 10 kt alloys.

DETAILED DESCRIPTION

Figure 1A:
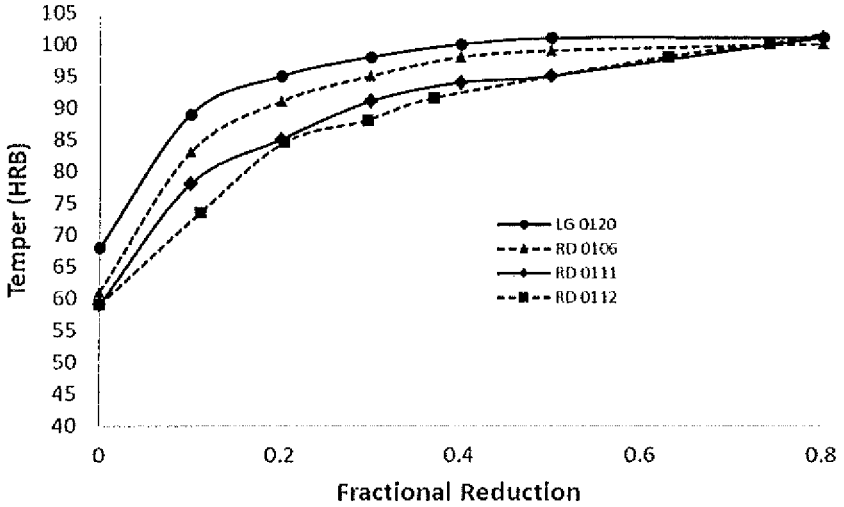
(FIG. 1A) Work-Hardening curves.
Figure 1B:
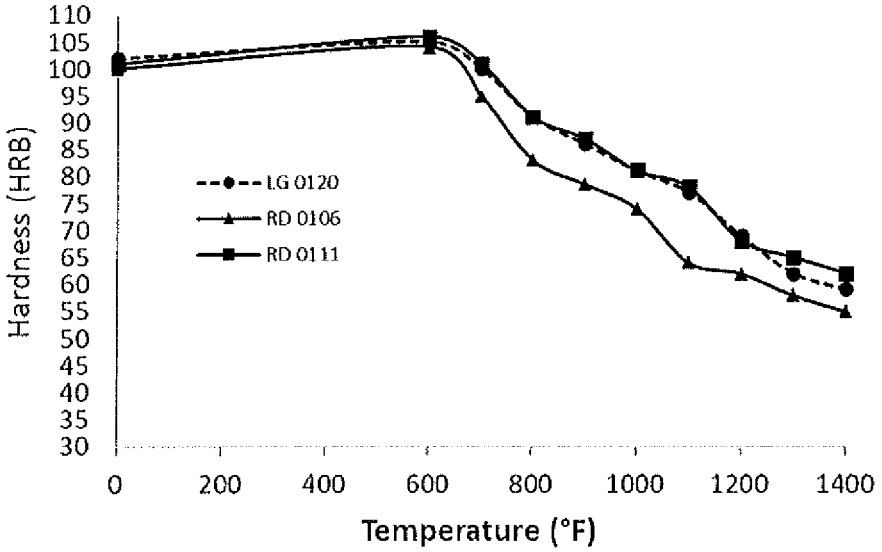
(FIG. 1B) Annealing curves.

Table 1 lists some of the low karat alloys developed and the tarnish/sweat test results. Prior to tarnish and sweat testing, the alloys were solution-annealed at 1200° F. for 1 hr and then air cooled. Any thermal oxides formed during annealing were removed using a mass finishing process. All the compositions developed had a comparable tarnish resistance to Leach-Garners 10 kt yellow gold denoted LG-0120, a prior art conventional 10 kt gold alloy. The addition of Pd and Pt improved the sweat resistance when compared to LG-0120.

TABLE 1

Tabulated Sweat and Tarnish Testing Results

| Alloy Numbers | Composition (% w/w) | Tarnish Resistance[A] | Sweat Resistance[B] |
|---|---|---|---|
| LG 0120 | Au 41.7; Ag 11.2; Ag: Cu 40.5; Zn 6.5 (prior art) | Yes | No |
| LG 0026 | Au 25.0; Ag 7.9; Cu 57.8; Zn 9.4 | =10 kt | =10 kt |
| RD 0100 G1236 | Au 25.0; Cu 52.5; Zn 22.5 | =10 kt | =10 kt |
| RD 0106 G1244 | Au 25.0; Cu 50.8; Zn 17.7; Ru 0.5; Pd 6.0 | =10 kt | >10 kt |
| RD 0107 G1245, G1246 | Au 25.0; Cu 48.8; Zn 20.6; Ru 0.5; Pt 5.0 | =10 kt | >10 kt |
| RD 0111 G1249 | Au 25.0; Cu 48.6; Zn 20.8; Pt 5.1; B 0.5 | =10 kt | >10 kt |
| RD 0112 G1252 | Au 25.0; Cu 54.6; Zn 18.4; Al 2.0 | =10 kt | >10 kt |
| RD 0114 | Au 25.0; Ag 7.9; Cu 55.7; Zn 8.9; Co 2.0; B 0.5 | =10 kt | =10 kt |
| RD 0115 G1256 | Au 25.0; Cu 50.8; Zn 15.2; Pd 6.0; Co 2.5; B 0.5 | =10 kt | >10 kt |

[A]Tarnish solution: Immersion in a 2% sulfurated potash (potassium sulfide) in deionized (DI) water solution at room temperature.
[B]Sweat solution: Immersion in a 0.5% sodium-chloride, 0.1% urea, and 0.1% lactic acid solution at room temperature.

Evaluation of samples: tarnish and sweat test results for a preferred 6 kt embodiment (RD 0106) were compared to the conventional LG 1020 alloy in cast rings that were dipped into the tarnish or sweat test solutions described in Table 1. After 2 mins in the tarnish solution, the RD 0106 and LG 0120 samples were identical, and showed no discoloration. After 20 hrs. of exposure to the sweat test solution the 10 kt alloy developed a dark corrosion layer, however the RD 0106 sample was resistant to corrosion and did not form a dark layer.

Table 2 compares the CIELAB colors of the inventive RD 0106 alloy compared with the prior art 10 kt LG 0120 alloy. The 6 and 10 kt colors are comparable although the 10 kt is slightly tinted red and the 6 kt is slightly tinted green. This is expected due to the high zinc content of the 6 kt alloy. After tarnish testing, both alloys darkened slightly (L decreased by about 13 points for each) but the colors were otherwise nearly indistinguishable between the two samples tested.

TABLE 2

CIELAB Color scale results

| Material | L | a | b |
|---|---|---|---|
| 6 kt-RD 0106 | 79.5 | −0.2 | 22.4 |
| 6k-RD 0106 - post tarnish | 66.5 | 0.1 | 26.2 |
| 10 kt LG 0120 (prior art) | 76.9 | −0.4 | 24.6 |
| 10 kt-LG 0120 - post tarnish | 64.0 | −0.5 | 28.7 |

CIELAB colors: L is a scale of lightness from black (0) to white (100), a is a measure from green (−) to red (+), and b is a measure from blue (−) to yellow (+). CIELAB was designed so that the same amount of numerical change in these values corresponds to roughly the same amount of visually perceived change In an embodiment, the inventive alloys have CIELAB colors (L, a, b) in a range of L=72 to 84; a=−1.0 to +1.0; b=17.5 to 28 (without exposure to a tarnish solution).

Table 3 compares the heat treatability of the 6 kt alloys with prior art 10 kt alloys. All alloys are annealed by exposure to 1000° F. to 1400° F. for 0.5 hours to 2.0 hours and rapidly cooled in air to room temperature. In an embodiment, the alloys are heat treated at 1200° F. for 1 hour and cooled to room temperature. Any thermal oxides formed during annealing were removed using a mass finishing process. The alloys are then heat treated, which for example can be performed in a furnace at 400° F. to 900° F. The workpiece is kept at this temperature for 0.5 to 3 hours and cooled to room temperature. In an embodiment, the workpiece is heat treated at 600° F. to 800° F. for one hour. This process of annealing followed by heat treatment will increase hardness and durability in finished parts made from these alloys.

The preferred RD 0106 6 kt alloy had moderate to little age hardenability. The addition of Ru (RD 0106 vs. LG 0026) made the alloys heat treatable while Co and B (RD 0114 and RD 0115) improved the overall hardness of the alloy. Co provided better age hardenability than Ru by standard metallurgical practice. A Pd—Ru master alloy should be used as this improves the dispersion of the hardening element more evenly through the cast structure. This will have the effect of improving hardenability as well as providing an increased response to heat treatment.

TABLE 3

Heat Treatability of 6 kt Alloys

| Alloy | Annealed Hardness (HRB) | Aged Hardness (HRB) | Quenching conditions |
|---|---|---|---|
| 10 kt LG 0120 | 78.0 | 87.5 | 1200° F., 1 hr air-cool → 600° F., 1 hr |
| 10 kt LG 0026 | 54.0 | 56.5 | 1200° F., 1 hr air-cool → 600° F., 1 hr |
| 6 kt RD 0106 | 63.5 | 71.0 | 1200° F., 1 hr air-cool → 700° F., 1 hr |
| 6 kt RD 0114 | 68.0 | 77.5 | 1200° F., 1 hr air-cool → 800° F., 1 hr |
| 6 kt RD 0115 | 73.5 | 81.0 | 1200° F., 1 hr air-cool → 800° F., 1 hr |

Experimental conditions: each sample is annealed by exposure to 1200° F. for 1 hour, then rapidly air cooled to room temperature. Any thermal oxides formed during annealing were removed using a mass finishing process. The annealed hardness was measured. Each sample was then heat treated for the described temperature (600°-800° F.) for one hour, and the aged hardness was measured.

The 6 kt alloys described here are highly workable using rod-rolling, sheet rolling, swaging, and wire drawing. FIGS.

1A and 1B give example work-hardening and annealing curves of these alloys. All 6 kt alloys have an improved work hardening capacity ($WH=HRB_{HARD:80\%\ Reduction}/HRB_{Annealed:\ 1200F,1\ hr}$) over the LG 0120 10 kt alloy (WH of RD 0106 is 1.71; WH of LG 0120 is 1.49). Adding Al (RD 0112, WH=1.72) and Pt & B (RD 0111, WH=1.71) improved the work-hardening capacity of the alloys. Improved hard hardening capacities means heavier cumulative reductions can be taken during wire/sheet/tube and deep drawing without being susceptible to necking failure. This resistance to necking means thinner gauge wire, tube, and shells can be more easily produced. The annealing curves indicate that ductility can be recovered by heat-treating above 1200° F. for 1 hr. From the hard temper, the alloys can also be further age-hardened by subjecting the material to a heat-treatment at 600° F. for 1 hr.

Figure 2A:
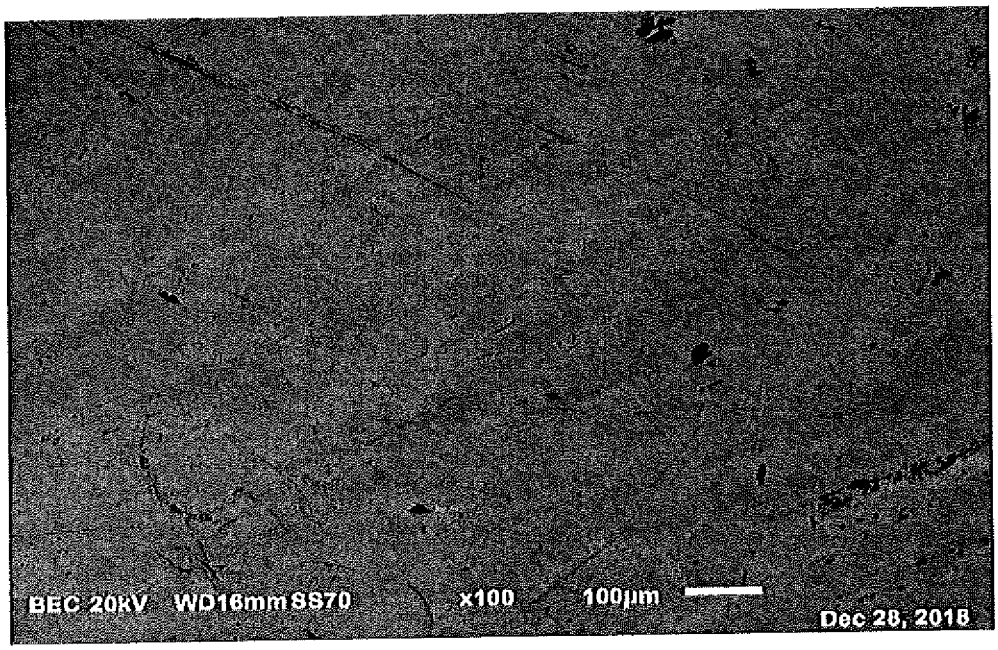
FIG. 2. Backscatter Electron Image (FIG. 2A) and EDS Spectra (FIG. 2B) of RD 0106 after tarnish testing.
Figure 2B:
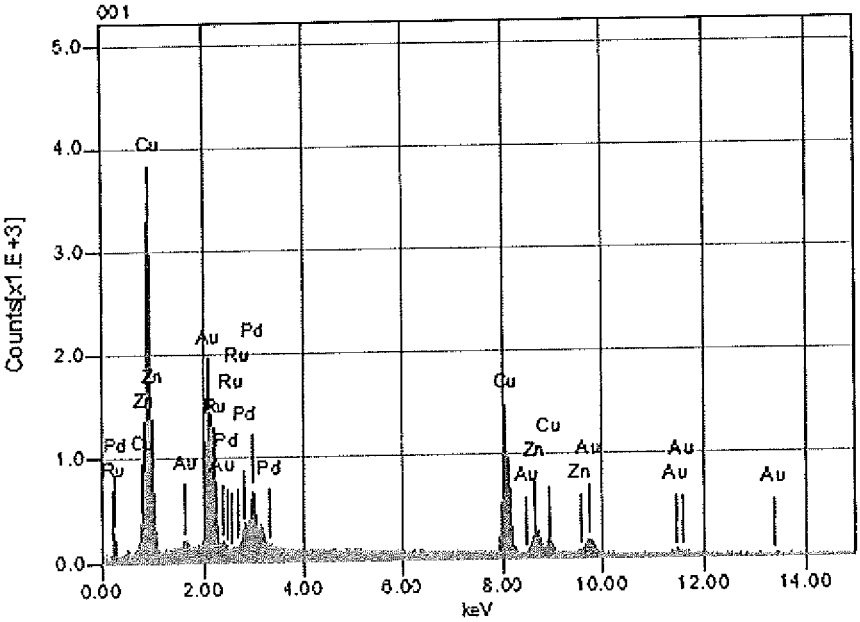
Figure 3A:
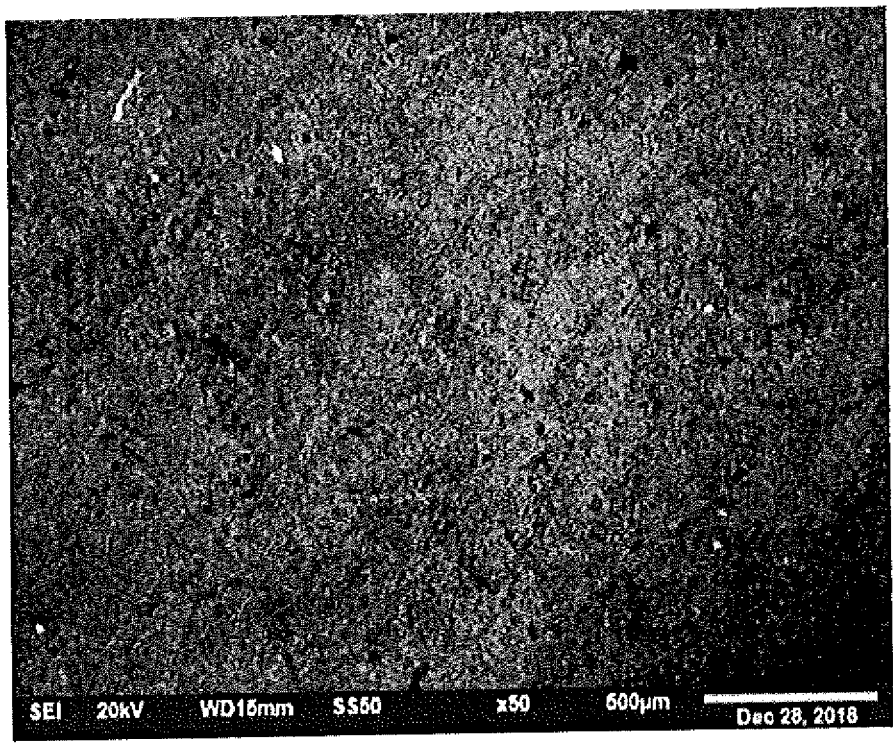
FIG. 3: Backscatter Electron Image (FIG. 3A) and EDS Spectra (FIG. 32) of RD 0106 before tarnish testing.
Figure 3B:
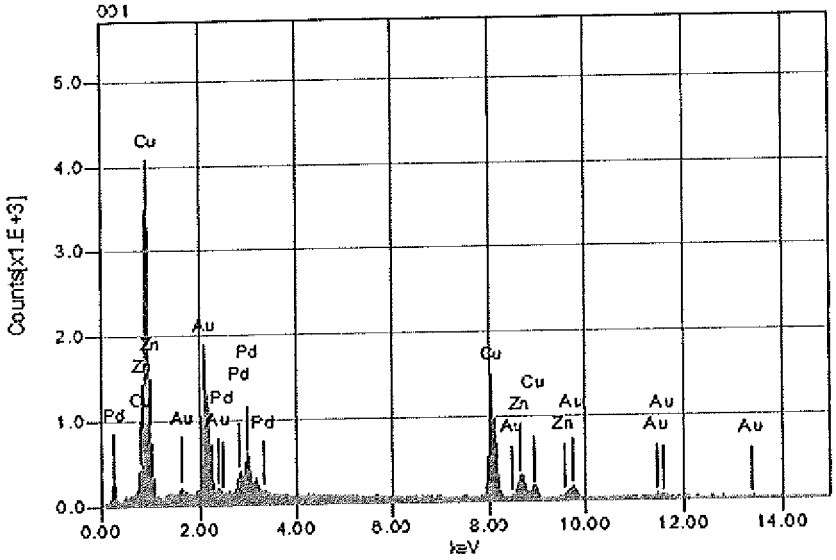

The improved tarnish resistance of the high zinc alloys can be attributed to a dealloying/gold-enrichment process. In the high zinc 6 kt alloys like RD 0106 the dealloying occurs during tarnish testing with Cu and Zn going into solution leaving behind a Au enriched, tarnish resistant layer. FIGS. 2 and 3 show electron backscatter images and Energy Dispersive Spectroscopy (EDS) spectra of tarnish tested and untested RD 0106. The chemistries of these samples are tabulated in Table 4. Clearly the surface after testing was enriched in Au after tarnish testing. This is not true for LG 0026, which showed no surface enrichment of gold. This phenomenon was observed previously in higher karat golds during exposure to corrosive media such as chloride solutions where the copper and zinc were leeched out leaving behind a gold-enriched surface (Gunnar Hultquist. Surface enrichment of low gold alloys. Gold Bulletin. June 1985, Volume 18, Issue 2, pp 53-57 https://doi.org/10.1007/BF03214686). Since hydrogen-sulfide ($H_2S$) is formed in the tarnish test solution of potassium sulfide and DI water it is expected the Zn and Cu would react with the $H_2S$ leading to the formation of ZnS and CuS. However, based on our observations the CuS/ZnS precipitates do not form a stable, adherent film and get corrosively removed leading to Au-enrichment at the surface.

TABLE 4

EDS Chemistry Results of 6 kt Tarnish Test Samples

| Experiment | Au | Cu | Zn | Ag | Pd |
|---|---|---|---|---|---|
| RD 0106 - Before Tarnish Test | 26.45 | 51.22 | 16.78 | 0.00 | 5.13 |
| RD 0106- After Tarnish Test | 30.43 | 47.61 | 13.96 | 0.00 | 5.62 |
| LG 0026- Before Tarnish Test | 25.41 | 56.70 | 8.77 | 8.80 | 0.00 |
| LG 0026- After Tarnish Test | 25.01 | 55.18 | 8.88 | 9.96 | 0.00 |

All numbers are % w/w.

The inventive alloys can be formed into jewelry or other articles by wrought or casting production methods.

Example 1. Casting Procedure in Neutec J-zP Casting Machine

Grain size in gold alloys for jewelry manufacture is important because of its influence on a material's properties and behavior. A metal structure is a combination of three-dimensional crystals (grains) of varying sizes and shapes. Rolling and drawing elongates the grains and introduces stresses. Annealing relieves the stresses and recrystallizes the grains. Grain growth occurs when these thermo-mechanical processes are inadequately controlled. A material with "large" grain is generally softer and more ductile (though weaker) than the same material with smaller grain. Jewelry made from large grain material often exhibits an undesirable rough surface (orange peel). Supplying soft, ductile materials with fine grain is a challenge to the manufacturer.

Grain (small round uniform pellets of solid alloy) was added to the crucible of the casting machine at room temperature. The crucible was then heated with argon purge of the crucible chamber at 5 L/min. The mold was preheated to 1300° F. and loaded into the chamber when the crucible temperature was 1620° F. The chamber temperature was increased to 1800° F. and the alloy was poured into the mold. The casting was quenched in water 2 mins after pouring.

TABLE 5

Composition of alloys in casting experiment

| Alloy Number | Composition (% w/w) |
|---|---|
| G0026 | Au 25.0; Ag 7.9; Cu 57.8; Zn 9.4 |
| G0026 + Grain refiners | Au 24.92; Ag 7.9; Cu 57.52; Zn 9.38; B 0.05; Ir 0.05; Si 0.18 |

Figure 4A:
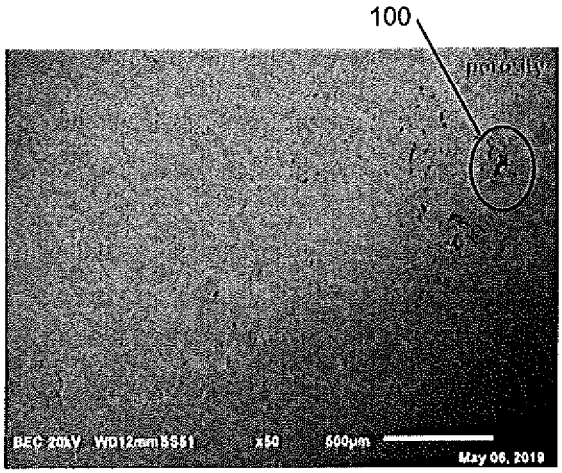
FIGS. 4A and 4C are electron micrographs of cast alloy G0026 (Example 1).
Figure 4B:
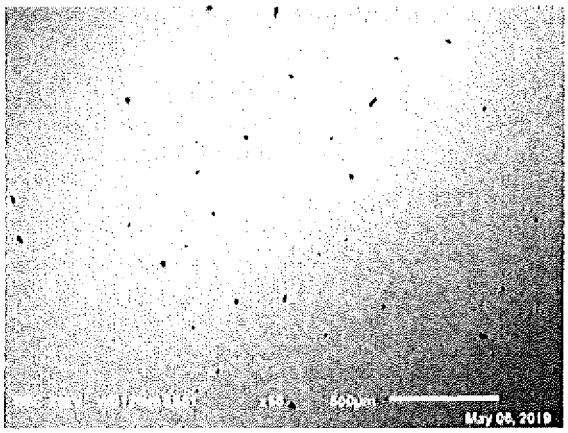
FIGS. 4B and 4D are electron micrographs of cast alloy G0026 with grain refiners (Example 1).
Figure 4C:
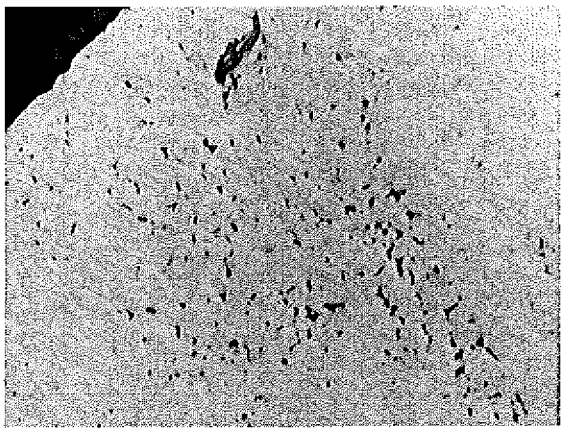

The cast structure of alloy G0026 without grain refiners added is columnar/dendritic, which is undesirable and can cause casting issues, such as porosity, cracks, or breaking in cast products. FIG. 4A is an electron micrograph of G0026, having columnar/dendritic morphology, and large porosities (100). FIG. 4C is another electron micrograph of alloy G0026 without grain refinement showing porosity that tends to be interconnected.

Figure 4D:
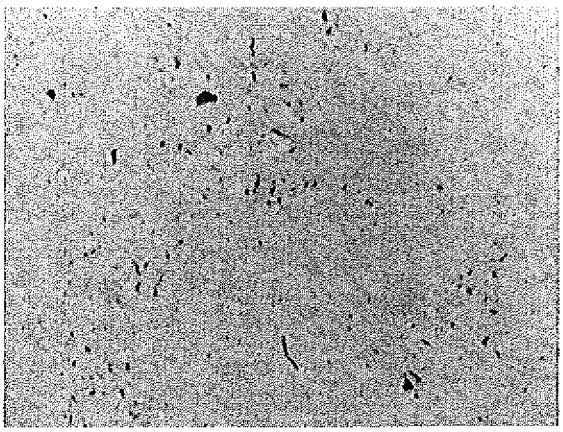

Grain refinement, from adding grain refiner materials to the mixture, including silicon, iridium, or boron, produces a mixture of equiaxed/dendritic and equiaxed/co-cellular grains, which have superior casting properties. The addition of grain refiners causes the porosity to be more isolated. The grain refinement tends to break up large pockets of porosity that otherwise would form. FIG. 4B is an electron micrograph of G0026 with grain refiners added (Table 5), showing the appearance of equiaxed/dendritic and equiaxed/co-cellular grains. No large porosities are present, FIG. 4D is an alternative electron micrograph of alloy 00026 with grain refiners (Table 5) showing how the added grain refiners tend to break up the porosity compared to the sample (FIG. 4C) without grain refiners. The G0026 with grain refiners is a soft, ductile materials with fine grain suitable for fabrication into high quality jewelry items such as rings, balls, chain, hoops and studs.

Casting without boron or silicon additives was discolored due to copper oxide formation during cooling after pouring. Boron/silicon additives appeared to produce a "bright" casting (i.e., higher L in the CIELAB color scale) by preventing thermal oxidation of copper. Close inspection using an eye-loop didn't reveal any tears or porosity.

Conclusions: The combination of boron, iridium and silicon appeared to change the solidification structure from columnar/dendritic to equiaxed/dendritic and equiaxed/co-cellular. The grain refinement appears to break up or redistribute the micro porosity thereby producing a more sound casting. The grain refiners also produced a brighter casting by preventing the thermal oxidation of copper.

The invention claimed is:

1. A castable 6 karat gold alloy comprising (w/w):

Au 25%;

Cu 45-60%;

Zn 15-21%;

at least one additional element selected from the group consisting of Al at up to 2%, Pd 4-6%, and Pt 4-6%; and Co exceeding 3% and not exceeding 4%.

2. The alloy of claim 1, wherein the alloy has CIELAB colors (L, a, b) in a range of L=72 to 84; a=−1.0 to +1.0; b=17.5 to 28.

3. The alloy of claim 1 wherein said at least one additional element is limited to Al.

4. The alloy of claim 3, wherein the alloy has CIELAB colors (L, a, b) in a range of L=72 to 84; a=−1.0 to +1.0; b=17.5 to 28.

5. The alloy of claim 1 wherein said at least one additional element is limited to Pd.

6. The alloy of claim 5, wherein the alloy has CIELAB colors (L, a, b) in a range of L=72 to 84; a=−1.0 to +1.0; b=17.5 to 28.

7. The alloy of claim 1 wherein said at least one additional element is limited to Pt.

8. The alloy of claim 7, wherein the alloy has CIELAB colors (L, a, b) in a range of L=72 to 84; a=−1.0 to +1.0; b=17.5 to 28.

9. The alloy of claim 1, further including at least one additional additive to increase hardness selected from the group consisting of B, Ru, and Ir.

10. The alloy of claim 9, wherein the alloy has CIELAB colors (L, a, b) in a range of L=72 to 84; a=−1.0 to +1.0; b=17.5 to 28.

* * * * *